United States Patent [19]

Hedfeld

[11] Patent Number: 4,580,854

[45] Date of Patent: Apr. 8, 1986

[54] FURNITURE MEMBER

[76] Inventor: Guenter Hedfeld, Friedensstrasse 28, D-6301 Pohlheim, Fed. Rep. of Germany

[21] Appl. No.: 739,246

[22] Filed: May 30, 1985

[30] Foreign Application Priority Data

Dec. 15, 1984 [EP] European Pat. Off. ..... 84115543.5

[51] Int. Cl.[4] ..... A47C 43/00

[52] U.S. Cl. ..... 312/262; 312/140.2; 312/257 R

[58] Field of Search ..... 312/257 R, 262, 258, 312/140.2

[56] References Cited

U.S. PATENT DOCUMENTS

| | | | |
|---|---|---|---|
| 835,902 | 11/1906 | Damato | 312/262 |
| 1,559,878 | 11/1925 | Humphreys | 312/262 |
| 3,955,864 | 5/1976 | McDonald et al. | 312/262 |
| 3,975,069 | 8/1976 | DeLucia | 312/262 |
| 4,099,809 | 7/1978 | Leotta | 312/140.2 |

*Primary Examiner*—James T. McCall

*Attorney, Agent, or Firm*—Flynn, Thiel, Boutell & Tanis

[57] ABSTRACT

A furniture member includes a back wall, two sidewalls, a bottom wall and a top wall, which can be constructed framelike or solid. In order to facilitate disassembly, transport in a small space, and assembly and disassembly without tools, and to assure sufficient stiffness of the assembled furniture member, a post is provided on each side of the back wall, each post being wider than the back wall so as to project forwardly and rearwardly beyond it. Each sidewall has, in its rear region, a recess which receives a respective post of the back wall, each sidewall being connected to the associated post by upper and lower pivot joints. The pivot joints of the respective sidewalls are arranged on opposite sides of the back wall, so that in a collapsed condition each sidewall lies on a respective side of the back wall. The bottom and top wall are each connected to the sidewalls by two separable swivel joints arranged in the front regions of the sidewalls and, during rotary movement and depending on the direction of rotation, cause the top or bottom wall to move into or out of a condition tightly pressed against each of the sidewalls.

11 Claims, 17 Drawing Figures

FIG. 8
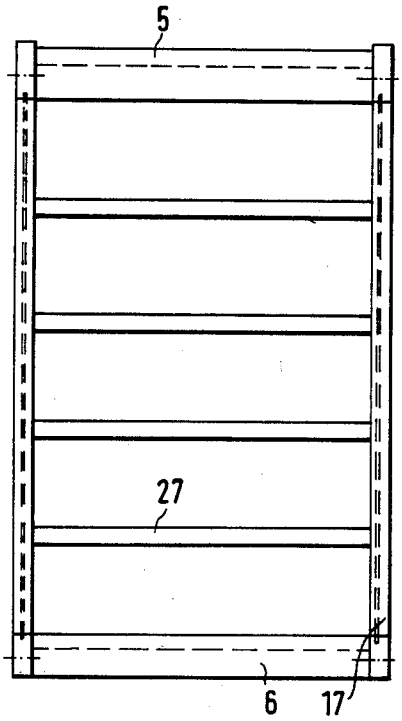
FIG. 9
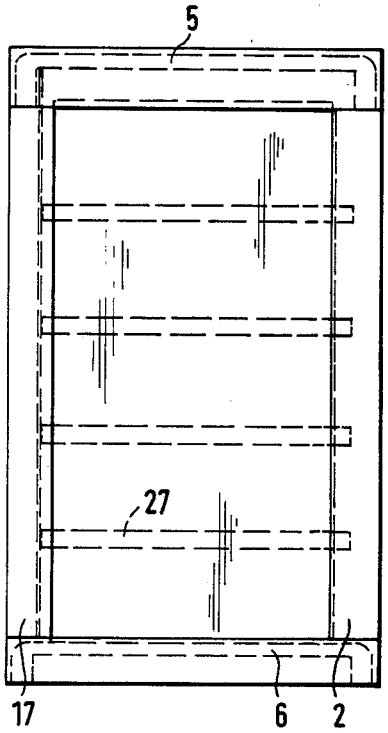
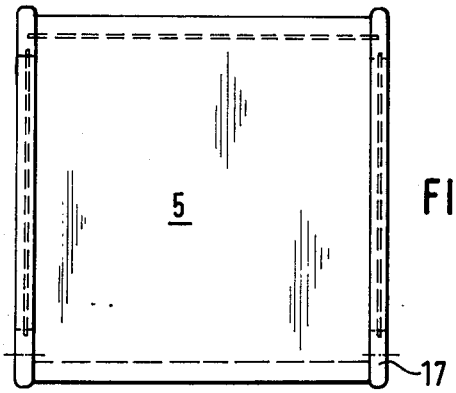
FIG. 10

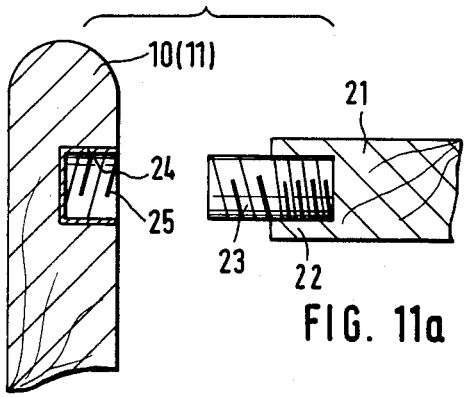
FIG. 11a
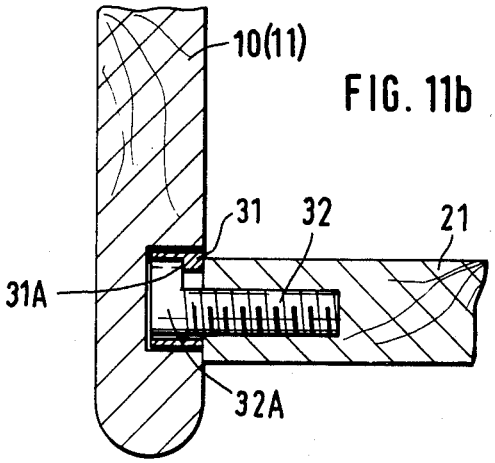
FIG. 11b
FIG.12
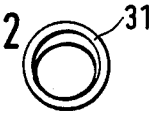
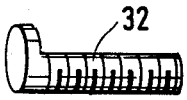
FIG. 14
FIG. 13
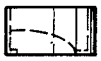

FIG. 15
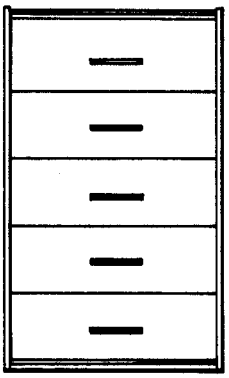
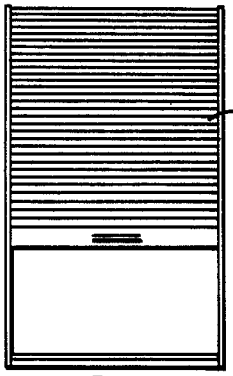
FIG. 18
FIG. 16
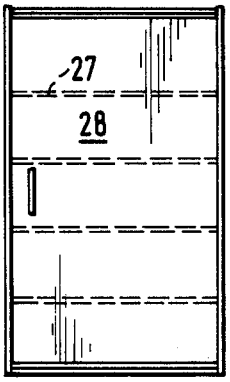
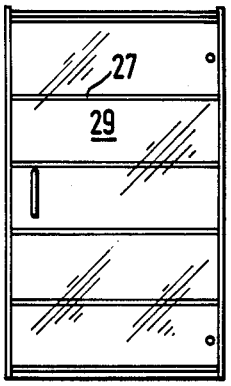
FIG. 19
FIG. 17
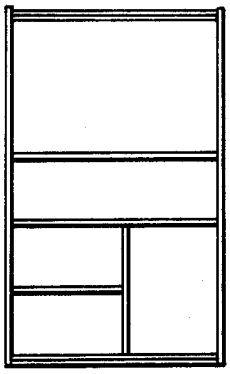

FURNITURE MEMBER

FIELD OF THE INVENTION

This invention relates to a furniture member and, more particularly, to a furniture member which includes a back wall, two sidewalls, a bottom wall and a top wall, which can each be constructed frame-like or solid.

BACKGROUND OF THE INVENTION

Furniture members of the aforementioned type are used to build cupboards, chests of drawers, glass cases etc. It is known to construct such furniture members so that they can be disassembled into a form in which they require only a small space for transport and can be sold in the form of so-called "take-along furniture". Known disassemblable furniture members, however, have the disadvantage that they are relatively expensive to assemble and require both screws and a tool for assembly. Also, disassembly and reassembly is difficult and time consuming, and does not meet the requirements of "mobile living". Further, in many of the known disassemblable furniture members it is found after assembly that they do not have the desired stiffness.

A basic purpose of the invention is to provide a furniture member of the above-mentioned type which can be easily disassembled and transported in a very little space, wherein the assembly of the furniture member can be carried out without a tool and with only a few manipulations, and wherein the furniture member has the necessary stiffness.

SUMMARY OF THE INVENTION

This purpose is attained by providing a furniture member which has on each lateral edge of its back wall a post which projects rearwardly and forwardly past the back wall. The posts are each movably received in a recess in a respective sidewall, and are each pivotally connected to the associated sidewall by a pivot joint. The pivot joints of the two sidewalls of the furniture member are on opposite sides of the back wall, that is, the pivot joints of one sidewall are located behind the back wall and the pivot joints of the other sidewall are located in front of the back wall. Through this, both sidewalls can be folded to positions parallel to the back wall for transport, each sidewall lying on a respective side of the back wall. The bottom wall and top wall are each connected by two swivel joints to the sidewalls near their front regions, the rear end of the top wall and the rear end of the bottom wall respectively engaging the top and bottom edges of the back wall in the assembled condition.

The swivel joints each preferably have two parts which are separable, and are advantageously constructed so that one part is a thread, bolt, eccentric or screw. One part is preferably connected fixedly to a sidewall and the other part to the top wall or the bottom wall. For coupling, for example, the top wall to the furniture member, the screws, bolts or eccentrics can be fixed against rotation in the side edges of the top wall, and can be introduced into nuts fixed against rotation in the respective sidewalls. Then, by pivoting the top wall through an angle of less than 360°, the screws are each screwed into the associated nut in the sidewalls. During the pivoting of the top wall, the screws cause the top wall and the sidewalls to become pressed against one another, the screw and the nut being adjusted to one another so that the desired pressing force of the sidewall against the top wall occurs when the top wall engages the top of the back wall. The bottom wall is coupled to the furniture member in the same manner, except that the direction of pivoting is turned around, that is, the bottom wall is swung under the furniture member until it engages the lower edge of the back wall.

The thickness of the posts and the thickness of the sidewalls are advantageously adjusted to one another, namely, both are preferably constructed with the same width. Furthermore, the extent to which each sidewall projects past its pivot joint is dimensioned so that, on the one hand, the pivoting of the sidewall into the transport position is assured and, on the other hand, the rear edges of each sidewall and the associated post are in alignment in the assembled condition. Moreover, the space between sides is arranged advantageously so that, in the assembled condition of the furniture member, each sidewall, in the region above and below the recess therein, does not engage the back wall. Rows of holes for fastening shelves, drawers, compartments, etc. in the furniture member can be provided in a conventional manner in the front region of the furniture member. Furthermore, doors, roller blinds, etc. can be supported in a conventional manner on the sidewalls.

BRIEF DESCRIPTION OF THE DRAWINGS

One exemplary embodiment of the invention will be described in greater detail hereinafter in connection with the drawings, in which:

FIGS. 8 to 10 are respectively a front view, a side view and a top view of the furniture member of FIG. 1 with shelves mounted therein;

FIG. 11*a* is a fragmentary sectional view of a swivel joint for connecting a sidewall to the top wall or bottom wall;

FIG. 11*b* is a fragmentary sectional view showing an alternative embodiment of the pivot joint of FIG. 11*a;*

FIGS. 12 and 13 are respectively a side view and a top view of a connecting part which is inserted into a sidewall and is a component of the pivot joint of FIG. 11*b;*

FIG. 14 is a perspective view of a connecting part which is inserted into the top wall or bottom wall and is a component of the pivot joint of FIG. 11*b;* and FIGS. 15 to 19 are front views similar to FIG. 8 of various alternative embodiments of the inventive furniture member.

DETAILED DESCRIPTION

Figure 1:
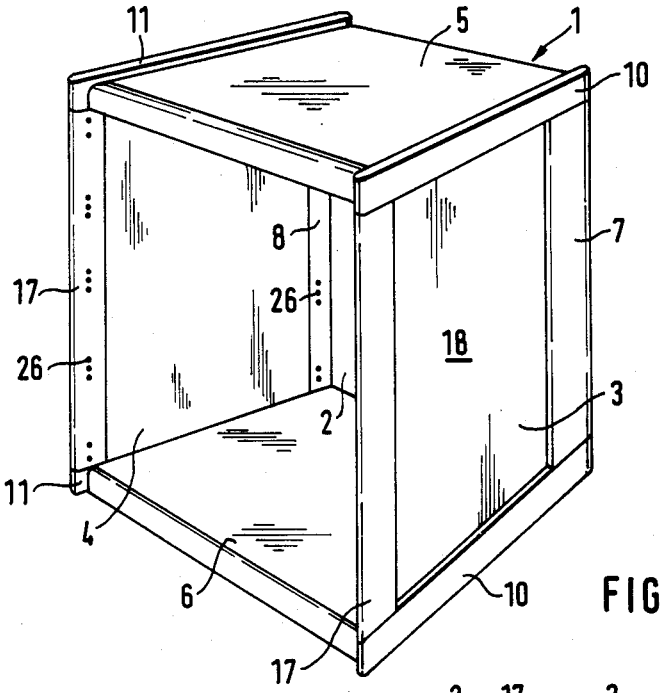
FIG. 1 is a perspective view of an inventively constructed furniture member.
Figure 2:
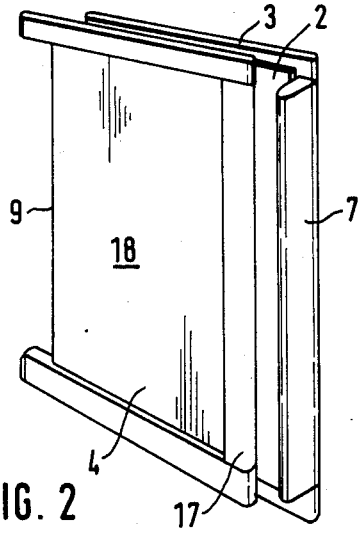
FIG. 2 is a perspective view of a back wall and two sidewalls of the furniture member of FIG. 1 in a totally collapsed condition.
Figure 3:
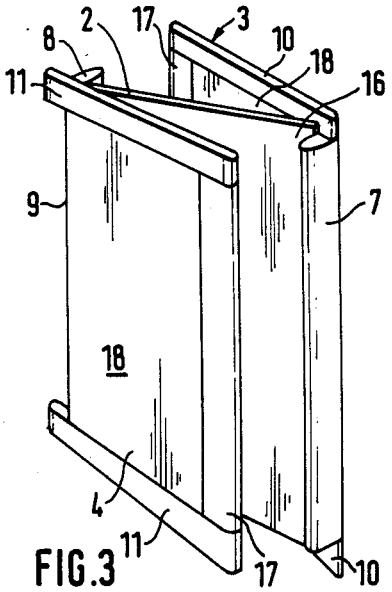
FIG. 3 is a view similar to FIG. 2, but showing the sidewalls in a partially opened condition.
Figure 4:
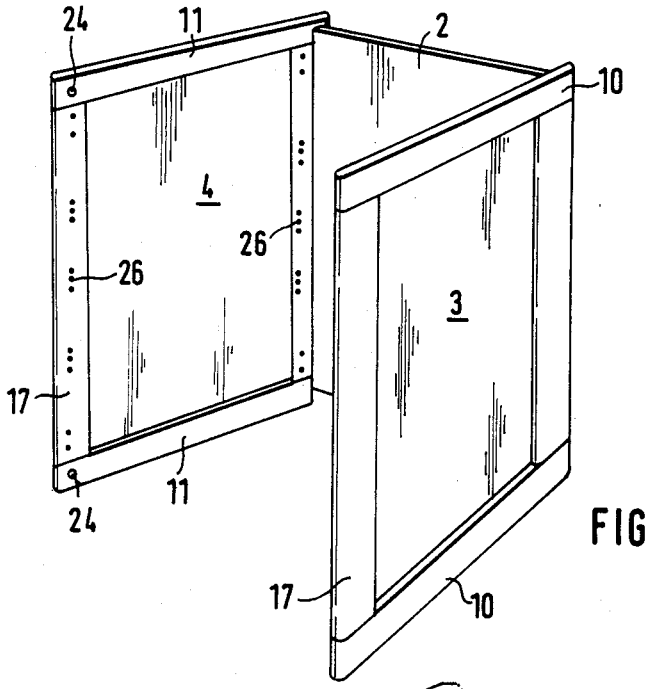
FIG. 4 is a perspective view similar to FIG. 2, but showing the sidewalls in a fully opened condition.
Figure 6:
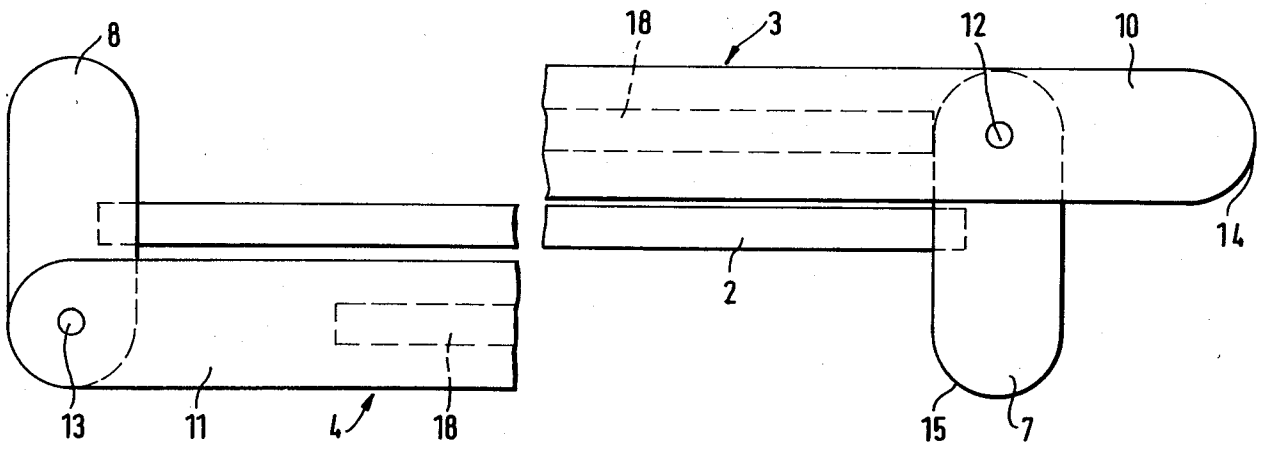
FIG. 6 is a fragmentary top view of the back wall and two sidewalls in the collapsed condition.

The furniture member 1 which is illustrated in the figures includes a back wall 2, two sidewalls 3 and 4 which are hingedly secured to the back wall, a top wall 5 and a bottom wall 6. Two posts 7 and 8 are laterally secured on the back wall 2, as can best be seen in FIG. 6. The posts 7 and 8 each extend, as shown in FIG. 6, both forwardly and rearwardly beyond the back wall 2. Recesses 9 (FIG. 2) are provided in the sidewalls 3 and 4 and receive the posts 7 and 8, the sidewalls 3 and 4 being pivotal relative to the posts 3 and 4. As shown in FIG. 1, the rear edge of each post 7 and 8 ends flush with the rear edge of the associated sidewall. Furthermore, the width of each post 7 and 8 equals the width of bars 10 and 11 of the sidewalls, so that when the sidewalls are unfolded into the position of FIG. 1, the side surfaces of the bars 10 and 11 lie flush with those of the posts 7 and 8.

Figure 7:
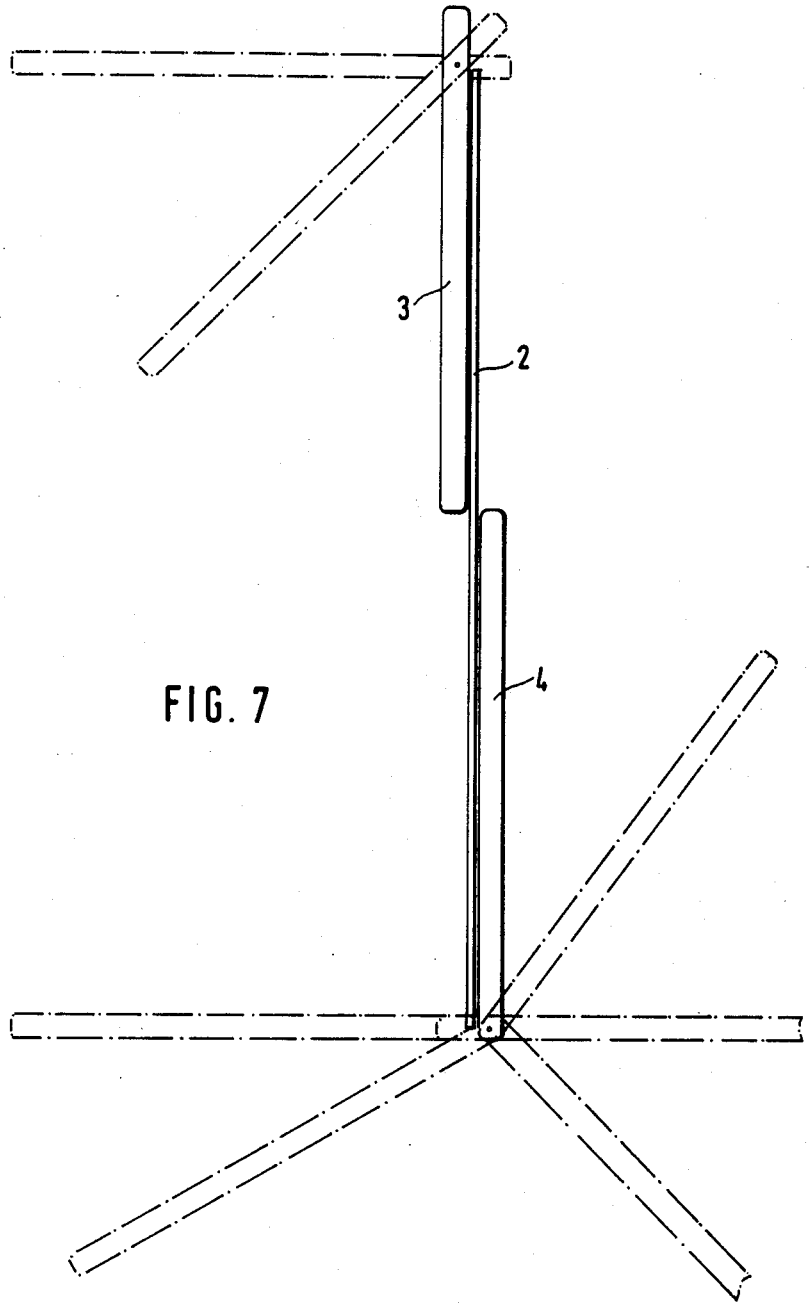
FIG. 7 is a top view of the sidewalls and back wall showing various angular positions of the sidewalls during unfolding thereof.

As can particularly be seen from FIG. 6, the sidewalls 3 and 4 are connected to the posts by pivot pins 12 and 13 arranged at the upper and lower ends of each post. The pivot pins 12 and 13 of each sidewall lie either in front of or behind the back wall, the distance of the pivot bearings 12 and 13 from the back wall 2 being chosen so that when the sidewall 3 is pivoted 90° from the illustrated position, the rear end 14 of the bar 10 will lie flush with the rear end 15 of the post 7. With respect to the sidewall 4, the pivot bearing 13 is spaced from the back wall by such a distance that when the sidewall 4 is pivoted 270° from the illustrated position its rear end lies flush with the rear end of the post 8. The sidewalls 3 and 4, in an unfolded position, have their top bars 10 and 11 engaging a part 16 of the back wall 2 which projects upwardly beyond the top of the post 7. FIG. 7 shows the possible pivoting range of the sidewalls 3 and 4 relative to the back wall 2.

The sidewalls in the exemplary embodiment each include lower and upper bars 10 or 11, and a front bar 17. A wall 18 is inserted into slots in these three bars. The wall 18 defines with its rear end the recess 9, in which is received the post 7 or 8.

Figure 5:
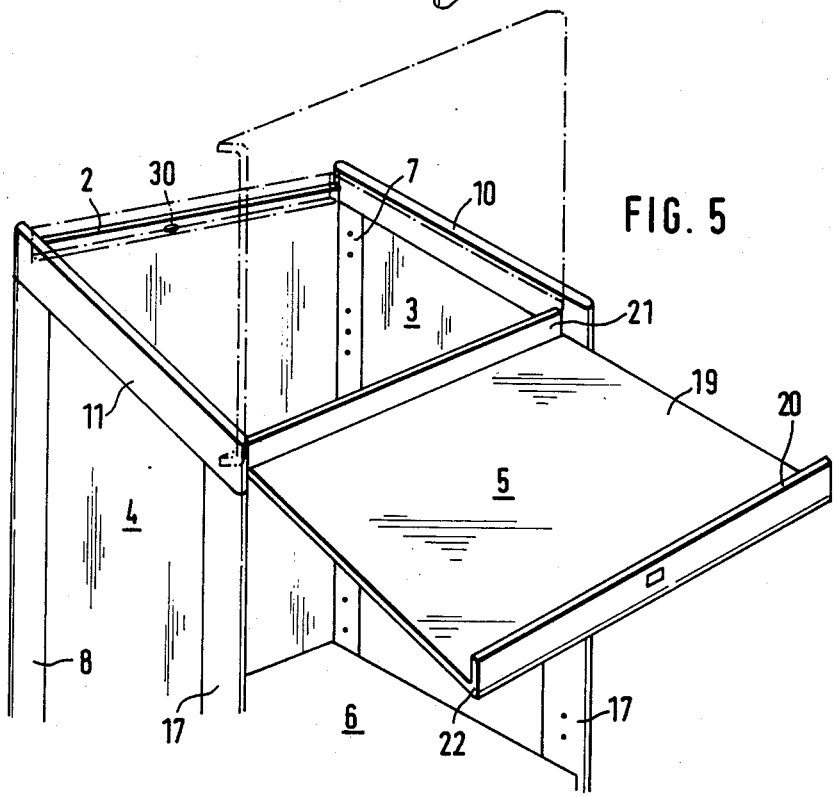
FIG. 5 is a fragmentary perspective view of the furniture member of FIG. 1 during mounting of the top wall.

FIG. 5 illustrates the assembly of the top wall 5 with the side and back walls. The top wall 5 includes a flat plate 19, at the ends of which are two flanges or tilted portions 20 and 21 which project outwardly in the same direction from the plate 19.

As can best be seen in FIG. 11*a*, a screw 23 is secured, so as to be fixed against rotation, in a lateral edge 22 of each tilted portion 21. Furthermore, a threaded nut 24 is secured, so as to be fixed against rotation, in the top bar 10 or 11 or each sidewall, each threaded nut 24 having an internal thread 25. To secure the top wall 5, the screws 23 thereon are each introduced into the associated threaded nut 24 with the top wall positioned as shown in solid lines in FIG. 5, and the top wall is then pivoted upwardly and rearwardly until the plate 19 rests on the back wall 2, the top edge of which is vertically lower than the top edges of the top bars 10 and 11 of the sidewalls 3 and 4 by an amount equal to the thickness of the plate 19. In this manner, the upper side of the plate 19 lies flush with the tops of the top bars 10 and 11. The plate 19 has its tilted portion 20 secured to the back wall 2 with a bolt 30 (FIG. 5).

The threads of the screw 23 and nut 24 are adjusted to one another in pitch and orientation so that, during pivoting of the top wall 10, the top wall 5 and the sidewalls 3 and 4 become tightly pressed against one another. A stiff connection of the sidewalls and top wall is achieved in this manner. The connection of the bottom wall 6 is done in the same manner as the connection of the top wall 5. In contrast to the pivoting direction of the top wall 5, the bottom wall 6 is pivoted in the opposite direction and extends under the bottom edge of the back wall 2, wherein the top and bottom walls assume the same basic position when installed. During the connection of the bottom wall to the sidewalls, they are pressed against one another, as occurred with the top wall, which assures a particularly high stiffness of the furniture member.

FIG. 11*b* shows an alternative embodiment of the swivel joint of FIG. 11*a*, in which a connecting pin 32 has a threaded semicircular shank which is secured in the flange 21 of the top wall and has a disklike head 32A at the outer end of and coaxial with the shank. A nut 31 has a helical shoulder 31A which can cooperate with the head 32A of pin 32 to move the bar 10 or 11 of the sidewall into tight contact with the flange 21 of the top wall in response to rotation of the top wall. The nut 31 is illustrated in an end view and in a side view in FIGS. 12 and 13, respectively. The pin 32 is shown in FIG. 14.

Fastening bores 26 are arranged in the inner surfaces of the front bars 17 of both sidewalls 3 and 4 and of the posts 7 and 8, which fastening bores accept pins on which shelves 27 can be supported, as illustrated for example in FIGS. 8 to 10.

FIGS. 15 to 19 illustrate possible finished versions of the inventively constructed furniture member. The member is provided with drawers in FIG. 15, which drawers are arranged on pull-out rails having pins inserted into the fastening bores 26 in the bars 17. FIGS. 16 and 19 each illustrate the furniture member with shelves 27 supported therein. The furniture member can be closed on its front side either with a pivotally supported wooden door 28 or a pivotally supported glass door 29, as is illustrated in FIGS. 16 and 19, respectively.

FIG. 17 illustrates a possible division of the furniture member into compartments having different sizes using divider walls, while FIG. 18 shows the furniture member with a roller blind 30.

The aforedescribed furniture member can also be constructed with a framelike sidewall and, if desired, a framelike back wall, so that it can then be used as a support for a shelf.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a furniture member which includes a back wall, two sidewalls, a bottom wall and a top wall, the improvement comprising wherein a respective post is mounted on each side of the back wall and is wider than and projects forwardly and rearwardly beyond the back wall, wherein each sidewall has a recess in a rear portion thereof which receives the associated post of the back wall, wherein each sidewall is connected by an upper and lower pivot joint to the associated post, wherein the pivot joints of the respective sidewalls are arranged on opposite sides of the back wall, wherein the bottom wall and the top wall are each connected to the sidewalls by two separable swivel joints which are arranged in the front region of the sidewalls and which effect, during rotary movement of the top or bottom wall in a first direction of rotation, a pressing of the sidewalls against the top wall or bottom wall and, during rotation in a second direction opposite the first direction, releasing of the top or bottom wall from the sidewalls, and wherein the top and bottom walls engage, at a rear portion thereof, an upper side or underside of the back wall.

2. The furniture member according to claim 1, wherein the sidewalls, in the region of the posts, have widths substantially equal to the widths of the posts.

3. The furniture member according to claim 1, wherein a rear end of each post is flush with the rear end of the associated sidewall in an assembled condition.

4. The furniture member according to claim 1, wherein the distance of the pivot joints of the sidewalls from the back wall is chosen so that each sidewall, in a disassembled condition, is adjacent and parallel to the back wall.

5. The furniture member according to claim 1, wherein the back wall is shorter than the sidewalls at its upper and lower ends by an amount equal to the thickness of the top wall and bottom wall, respectively.

6. The furniture member according to claim 1, wherein each sidewall is provided along its upper, lower and front sides with respective bars which each have a thickness equal to the thickness of the associated post.

7. The furniture member according to claim 6, including fastening means for hanging shelves, drawers, etc. in the furniture member, the fastening means being arranged on inner sides of the front bar of each sidewall and on the inner sides of each post.

8. The furniture member according to claim 7, wherein a sidewall element is inserted between the top, bottom and front bars of each sidewall.

9. The furniture member according to claim 1, wherein the swivel joints each include a nut and a screw for connecting the associated sidewall with the top or bottom wall, which nut and screw are each fixed against rotation with respect to the sidewall or the bottom wall and top wall.

10. The furniture member according to claim 9, wherein the pitch of the threaded nut and screw are adjusted to one another so that, after pivoting of the top wall or bottom wall less than 360°, each sidewall is pressed fixedly against the bottom wall or top wall.

11. The furniture member according to claim 1, wherein the back wall and sidewalls are framelike.

* * * * *